US006910957B2

(12) United States Patent
Taylor

(10) Patent No.: US 6,910,957 B2
(45) Date of Patent: Jun. 28, 2005

(54) METHOD AND APPARATUS FOR HIGH PRESSURE ARTICLE CLEANER

(76) Inventor: Andrew M. Taylor, 12306 Tangerine, San Antonio, TX (US) 78247

( * ) Notice: Subject to any disclaimer, the term of this patent is extended or adjusted under 35 U.S.C. 154(b) by 0 days.

(21) Appl. No.: 09/793,723

(22) Filed: Feb. 26, 2001

(65) Prior Publication Data

US 2001/0036801 A1 Nov. 1, 2001

Related U.S. Application Data

(60) Provisional application No. 60/184,881, filed on Feb. 25, 2000.

(51) Int. Cl.[7] ..... B24C 7/00
(52) U.S. Cl. ..... 451/99; 451/101; 451/102
(58) Field of Search ..... 451/99, 101, 102, 451/75, 89

(56) References Cited

U.S. PATENT DOCUMENTS

| | | | | | |
|---|---|---|---|---|---|
| 3,994,097 | A | * | 11/1976 | Lamb | 451/102 |
| 4,757,831 | A | | 7/1988 | Ingermann et al. | |
| 4,918,873 | A | * | 4/1990 | Bass | 451/38 |
| 4,922,664 | A | * | 5/1990 | Spinks et al. | 239/63 |
| 4,936,547 | A | * | 6/1990 | Obst | 251/304 |
| 4,945,688 | A | * | 8/1990 | Yie | 451/101 |
| 5,018,317 | A | * | 5/1991 | Kiyoshige et al. | 451/102 |
| 5,054,249 | A | * | 10/1991 | Rankin | 451/101 |
| 5,168,888 | A | | 12/1992 | Altwasser | |
| 5,545,073 | A | * | 8/1996 | Kneisel et al. | 134/7 |
| 5,601,478 | A | * | 2/1997 | Mesher | 239/591 |
| 5,616,067 | A | * | 4/1997 | Goenka | 239/318 |
| 5,643,058 | A | * | 7/1997 | Erichsen et al. | 451/100 |
| 5,660,580 | A | * | 8/1997 | Lehnig | 239/592 |
| 5,679,062 | A | * | 10/1997 | Goenka | 451/102 |
| 5,704,825 | A | * | 1/1998 | LeCompte | 239/594 |
| 5,779,523 | A | * | 7/1998 | Mesher | 451/101 |
| 5,795,214 | A | * | 8/1998 | Leon | 239/654 |
| 5,876,267 | A | * | 3/1999 | Kanda | 451/102 |
| 5,908,349 | A | * | 6/1999 | Warehime | 239/430 |
| 6,077,152 | A | * | 6/2000 | Warehime | 451/75 |
| 6,142,385 | A | * | 11/2000 | Tacoma | 239/71 |
| 6,168,503 | B1 | * | 1/2001 | Pao et al. | 451/102 |
| 6,203,406 | B1 | * | 3/2001 | Rose et al. | 451/102 |
| 6,283,833 | B1 | * | 9/2001 | Pao et al. | 451/102 |
| 6,293,857 | B1 | * | 9/2001 | Allard | 451/102 |
| 6,371,839 | B2 | * | 4/2002 | Izawa et al. | 451/75 |
| 6,383,062 | B1 | * | 5/2002 | Jou | 239/375 |
| 6,454,875 | B1 | | 9/2002 | Vogel | |

FOREIGN PATENT DOCUMENTS

| | | | | |
|---|---|---|---|---|
| JP | 04220272 A | * | 8/1992 | A63B/53/00 |

OTHER PUBLICATIONS

International Search Report–dated Sep. 7, 2004.

* cited by examiner

*Primary Examiner*—David B. Thomas
(74) *Attorney, Agent, or Firm*—Jenkens & Gilchrist, P.C.

(57) ABSTRACT

A cleaning system 210 having nozzle assembly 10 for a pressured fluid stream entrained with abrasive that includes a pressured fluid receiving portion 15 adapted to accommodate a pressured fluid dispenser 20. An abrasive entrainment chamber 25 is oriented to accept pressured fluid jetted thereacross from the pressured fluid dispenser. The abrasive entrainment chamber is adapted to establish a venturi suction responsive to pressured fluid being jetted thereacross. An access port 30 is provided in fluid communication with the abrasive entrainment chamber for permitting suction of abrasive into the abrasive entrainment chamber for entrainment in a pressured fluid being jetted thereacross. A spray enclosure 35 is positioned at the abrasive entrainment chamber and oriented to receive pressured fluid dispensed from the pressured fluid dispenser at the pressured fluid receiving portion. The spray enclosure is configured to substantially conform to a spray pattern 40 of pressured fluid jetted from the pressured fluid dispenser with minimized influence on the spray pattern at side-edge portions 45 thereof for promoting substantially uniform dispersion of pressured fluid and abrasive across the spray pattern.

11 Claims, 6 Drawing Sheets

METHOD AND APPARATUS FOR HIGH PRESSURE ARTICLE CLEANER

PRIORITY DESIGNATION

This application claims the benefit of U.S. Provisional Application No. 60/184,881 filed Feb. 25, 2000.

INDUSTRIAL APPLICABILITY

The present invention finds applicability in cleaning industries, and more specifically in industries in which high-pressure washes, and especially washing processes In which abrasives are entrained in a fluid medium may be advantageously utilized.

BACKGROUND ART

High-pressure blast cleaning systems are well known. Such systems are often used to clean durable surfaces such as concrete and other pavements. They are also frequently used to remove such things as graffiti from building exteriors. In an effort to affect a more thorough cleaning, abrasives such as sodium bicarbonate have been added to power washers. Examples of such apparatus and methods of utilization are found in U.S. Pat. Nos. 5,366,560 and 5,588,901. the inventions of those patents were co-invented by the present inventor. certain drawbacks, however, had the idea of filed with respect to who those designs but we used in those devices.

A primary deficiency lies in the construction of the distribution nozzle. In its present configuration, the side portions of the nozzle encroach upon the distributed spray at side portions thereof. As a result, both water and abrasives are concentrated at the side portions of the fan-shaped spray causing a more abrasive effect at both locations on targeted objects. The result can be more thorough cleaning or uneven removal of surface coatings such as paint; in either case, the end result is uneven striping. Therefore, it is desirable to establish a more uniform dispersion of both fluid and abrasive across the spray front.

There are also other environments in which blast-type cleaning could be advantageously utilized. By way of example only, these environments may include the cleaning of such articles as automotive parts and the like, as well as sports equipment apt to be soiled, such as golf clubs. In these situations, the cleaning of such articles will often be performed indoors, and therefore it would be advantageous to have a containing compartment within which the wash process may be performed.

In view of the above described deficiencies associated with the use of known designs for high-pressure blast cleaning systems, and the recognition of other environments in which the blast system of the present invention may be exploited, the advantageous methods and systems disclosed herein have been developed to alleviate these drawbacks and meet the needs of the indicated industries. These enhancements and benefits are described in greater detail hereinbelow with respect to several alternative embodiments of the present invention.

DISCLOSURE OF THE INVENTION

The present invention in its several disclosed embodiments alleviates the drawbacks described above with respect to conventionally designed high-pressure wash systems and incorporates several additionally beneficial features. Furthermore, special configurations are disclosed for forming cleaning compartments or enclosures to be utilized for cleaning articles placed therein. These compartments have power washing apparatus incorporated therein configured according to the present teachings for a superior abrasive wash system.

As an additional enhancement to the nozzle assembly, an embodiment is disclosed in which one side portion of the enclosure for the fan-spray is adapted to form a gum scraper to be utilized when flooring and like surfaces are being cleaned.

The beneficial effects described above apply generally to the exemplary devices and mechanisms disclosed herein of the high pressure spray nozzle with abrasive feed arrangement, especially as an incorporation into a system and method for cleaning various articles within an enclosed compartment. The specific structures through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

Figure 1A:
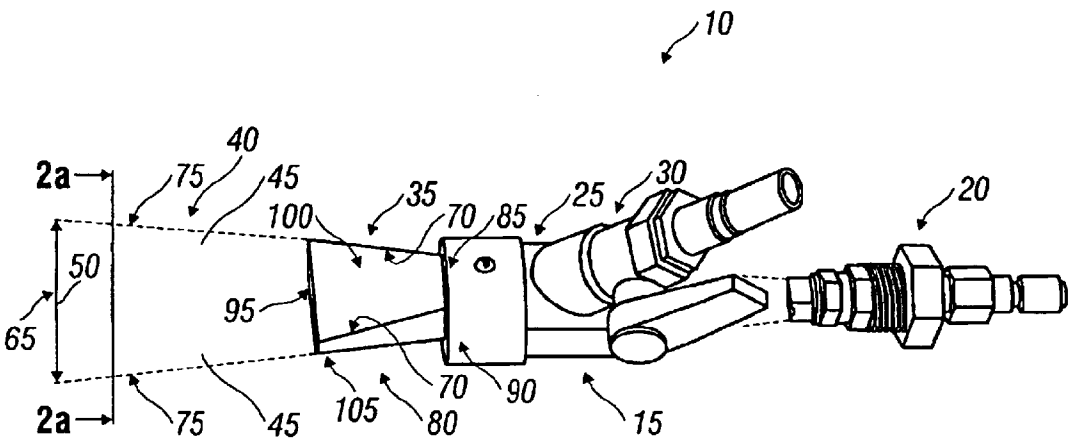
FIGS. 1*a* and 1*b* serve as comparative views between the nozzle assembly of the present invention and a previously known design, respectively.
Figure 1B:
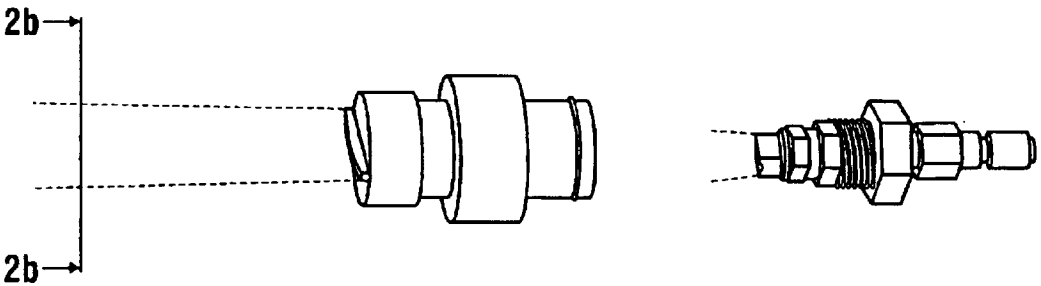
FIG. 1b ( PRIOR ART )
Figure 2A:
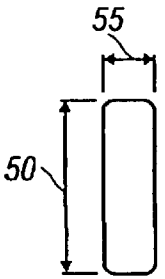
FIGS. 2*a* and 2*b* are cross-sectional views of the developed spray patterns taken along the lines 2*a*—2*a* (present invention) and 2*b*—2*b* (previously known design) of the spray, respectively.
Figure 2B:
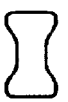
FIG. 2b ( PRIOR ART )
Figure 3:
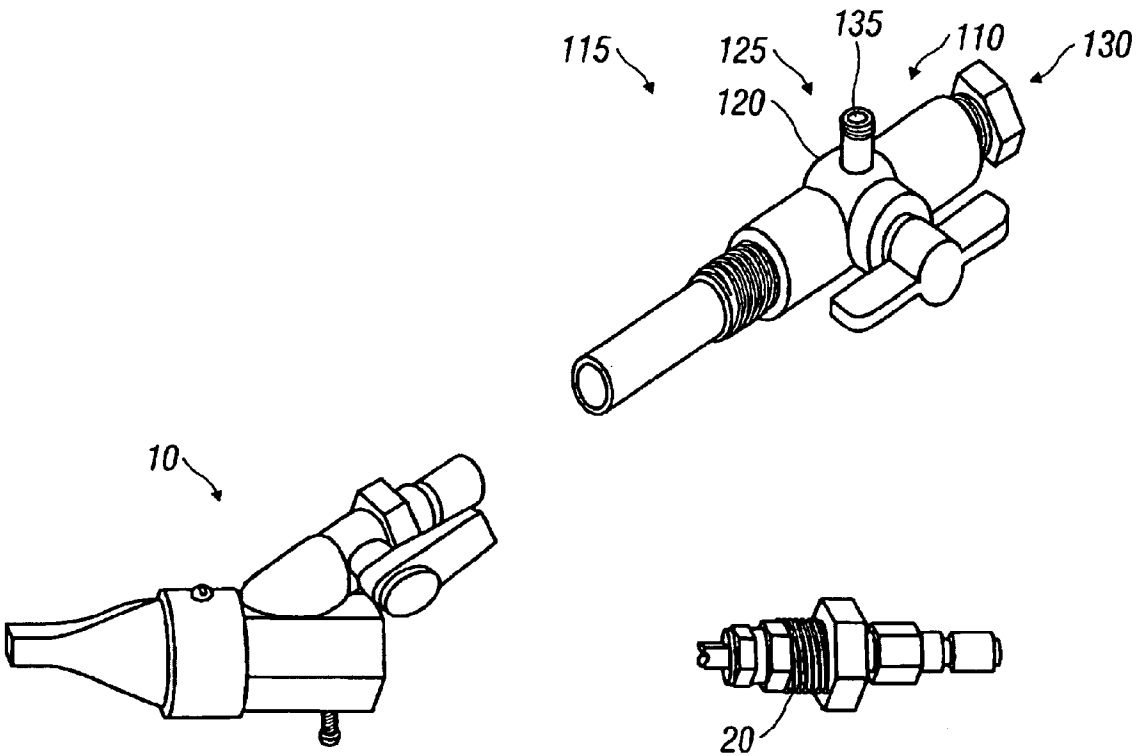
FIG. 3 is an exploded perspective view of the nozzle assembly and the abrasive entraining assembly.
Figure 5:
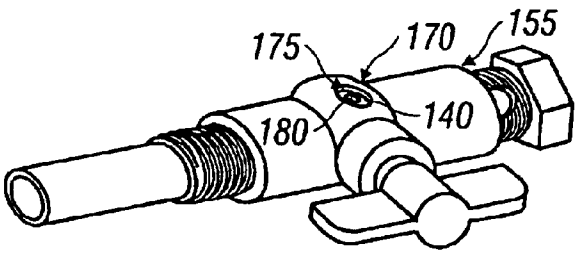
FIG. 5 is a top plan view of the abrasive entraining assembly with the ball member exposed showing an abrasive inlet aperture.
Figure 6:
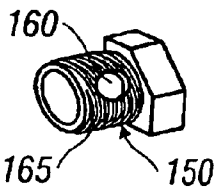
FIG. 6 is a detailed perspective view of the variably adjustable closure member of the air intake of the abrasive entraining assembly.
Figure 4:
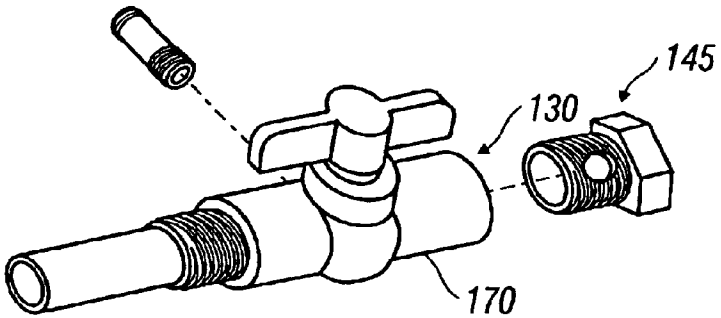
FIG. 4 is an exploded perspective view of the abrasive entraining assembly.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Referring to Figs., a nozzle assembly 10 for a pressured fluid stream entrained with abrasive is shown. The nozzle includes a pressured fluid receiving portion 15 adapted to accommodate a pressured fluid dispenser 20. An abrasive entrainment chamber 25 is oriented to accept pressured fluid jetted thereacross from the pressured fluid dispenser. The abrasive entrainment chamber is adapted to establish a venturi suction responsive to pressured fluid being jetted thereacross. An access port 30 is provided in fluid communication with the abrasive entrainment chamber for permitting suction of abrasive into the abrasive entrainment chamber for entrainment in a pressured fluid being jetted thereacross. A spray enclosure 35 is positioned at the abrasive entrainment chamber and oriented to receive pressured fluid dispensed from the pressured fluid dispenser at the pressured fluid receiving portion. The spray enclosure is configured to substantially conform to a spray pattern 40 of pressured fluid jetted from the pressured fluid dispenser with minimized influence on the spray pattern at side-edge portions 45 thereof for promoting substantially uniform dispersion of pressured fluid and abrasive across the spray pattern.

In one embodiment, at least one of the side-edge portions 45 is extended thereby forming a chewing gum scraper that can be utilized when mechanical scrapping in addition to the abrasive spray wash is required to remove a piece of discarded chewing gum which has become cement-like upon a flooring surfaces.

As indicated, a pressured fluid dispenser is positioned at the pressured fluid receiving portion and arranged to spray a substantially fan-shaped pressured fluid jet across the abrasive entrainment chamber. The fluid jet has a width-wise axis 50 and a height-wise axis 55. The height-wise axis is measured substantially perpendicular to the width-wise axis. The fluid jet has two side-edge portions 45, one each on either of two sides and adjacent to an interior portion 65 of the fluid jet. The fluid jet has a substantially uniform dispersion along the width-wise axis with respect to both the fluid carrier or medium, usually water or a water-containing solution, and abrasive material such as sodium bicarbonate entrained therein.

The spray enclosure is substantially fan-shaped in a plane oriented to include the width-wise axis of the fluid jet and perpendicularly intersecting the height-wise axis of the fluid jet. The spray enclosure has interior side walls configured to substantially align, causing a minimum of interference, with outer side-surfaces of the fluid jet.

The spray enclosure is of a substantially truncated triangular-shape 80 in the plane oriented to include the width-wise axis of the fluid jet and perpendicularly intersecting the height-wise axis of the fluid jet. The truncated end 85 forms an inlet 90 for pressured fluid directed thereinto. The spray enclosure flares outwardly from the inlet to an exit 95 along the plane thereby maintaining a substantially uniform fluid dispersion across the width-wise axis.

The spray enclosure has top and bottom walls 100,105 respectively, that converge toward one another from the inlet to the exit along the height-wise axis for focusing the fluid jet and thereby facilitating the maintenance of the substantially uniform fluid dispersion across the width-wise axis.

A shut-off valve is arranged across the access port for permitting, prohibiting and adjusting an abrasive load drawable into the abrasive entrainment chamber.

An abrasive entraining assembly 110 is associated with the nozzle assembly comprising. An abrasive metering assembly 115 comprising a ball valve 120 is positioned at a juncture 125 between an air intake 130, an abrasive supply 135 and the access port 30 for controlling fluid communication therebetween. A ball member 135 of the ball valve is adapted to regulate an amount of abrasive permitted to be deployed from the abrasive supply into air taken up through the air intake.

The air intake further includes a variably adjustable closure member 145 adapted to increase and decrease amounts of air permitted to be drawn through the air intake by rotation of the closure member. The closure member has a threaded cylindrical portion 150 adapted to be threadedly received in a tapped receiver 155 in the abrasive metering assembly. At least one inlet aperture 160 extends through a side wall 165 of the closure member and is arranged to have a degree of openness thereof adjustable by rotation of the closure member.

The abrasive metering assembly further includes a housing body 170 having an abrasive supply inlet 175 extending therethrough and arranged to communicate with an abrasive inlet aperture 180 through the ball member of the ball valve when the abrasive entraining assembly is in an abrasive dispensing configuration. The ball member has an open cylinder 185 (not shown) extending therethrough and arranged to align with the abrasive supply inlet in an abrasive blocking configuration. The open cylinder is arranged to form a flow-through channel across the abrasive metering assembly in an abrasive dispensing configuration.

The inlet aperture extends through a wall 190 (not shown) of the open cylinder and is arranged to dispense abrasive into the abrasive entraining assembly when the abrasive metering assembly is in an abrasive dispensing configuration.

In one particularly advantageous configuration, one or more nozzle assemblies 10 are incorporated into a cleaning system 210 adapted for cleaning, polishing and similar treatments of different articles. In the illustrated embodiment of FIGS. 7 through 9, an article cleaning system 210 is shown in the form of an abrasive golf club washing and polishing machine. In a basic cleansing procedures performed by the cleaning system 210, a plurality of golf club heads are high-pressure washed utilizing at least two nozzle assemblies 10. During the cleansing process, the golf club heads are first scoured with high-pressure, abrasive entrained water from at least two angles. These angles of application of the cleaning solution upon the clubs is established by the set orientation of the two nozzle assemblies 10. Following the scouring step, a rinsing step is completed that rids of the golf clubs of any soil traces, but more usually latent abrasive material remaining after the washing cycle. Because of the abrasive material entrained into the water wash, a polishing effect is also achieved.

Figure 7:
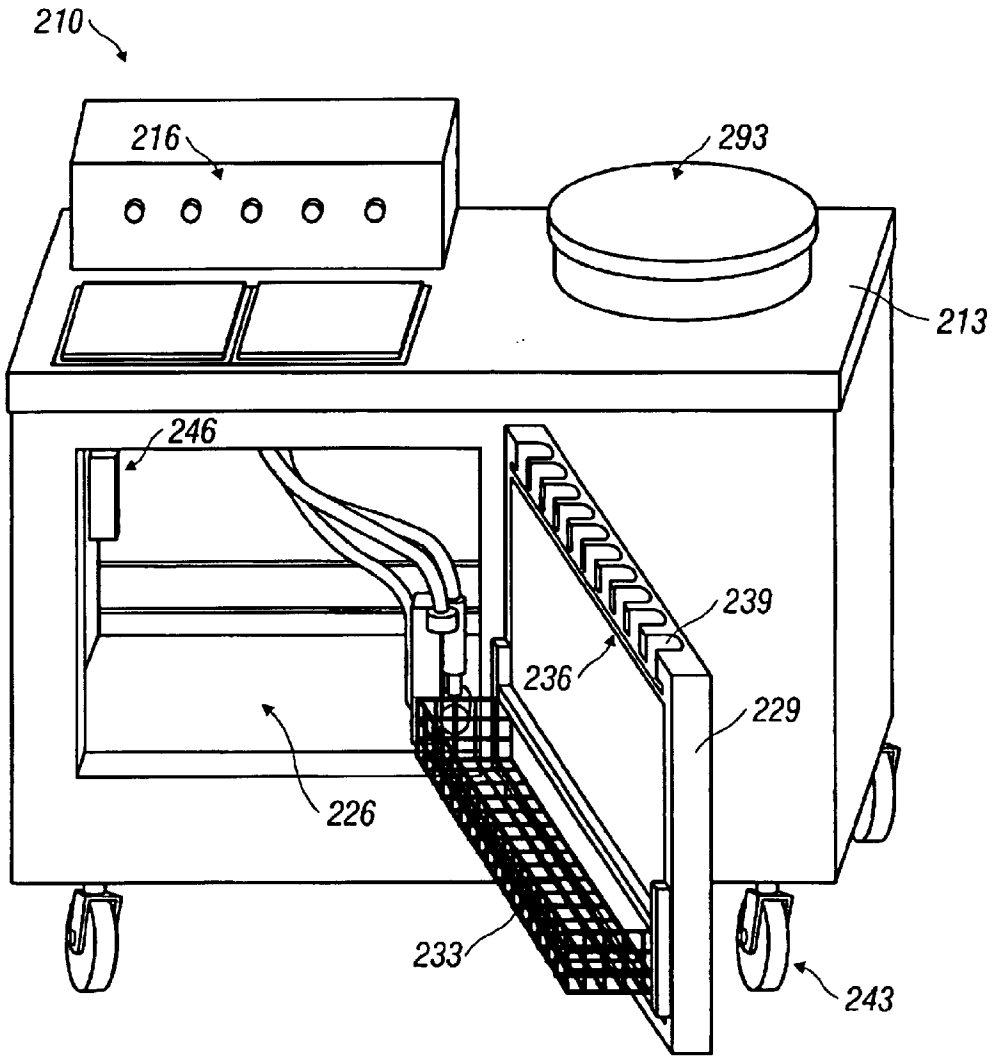
FIG. 7 is a perspective view of an article cleaning system according to one embodiment of the present invention taken from the front side with the door open revealing characteristics of the interior of the cleaning compartment.
Figure 8:
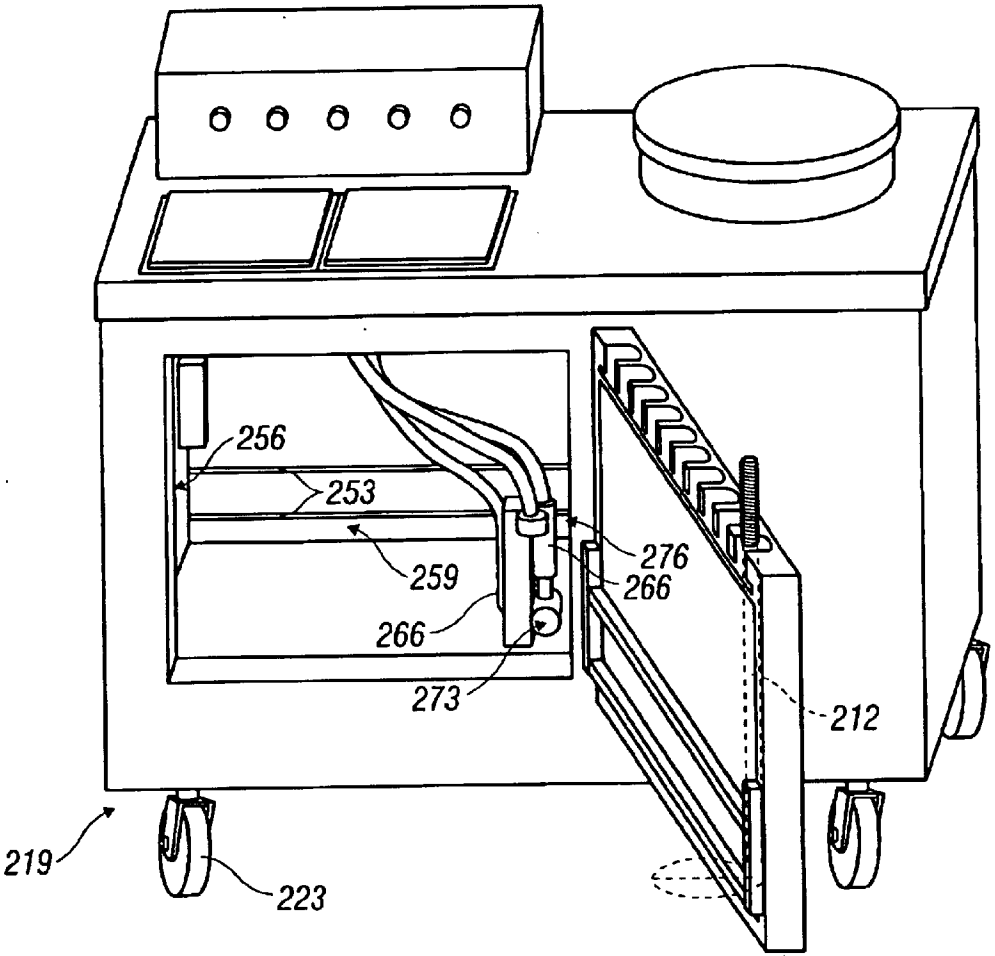
FIG. 8 is a more detailed illustration of the cleaning compartment as shown in FIG. 7.
Figure 9:
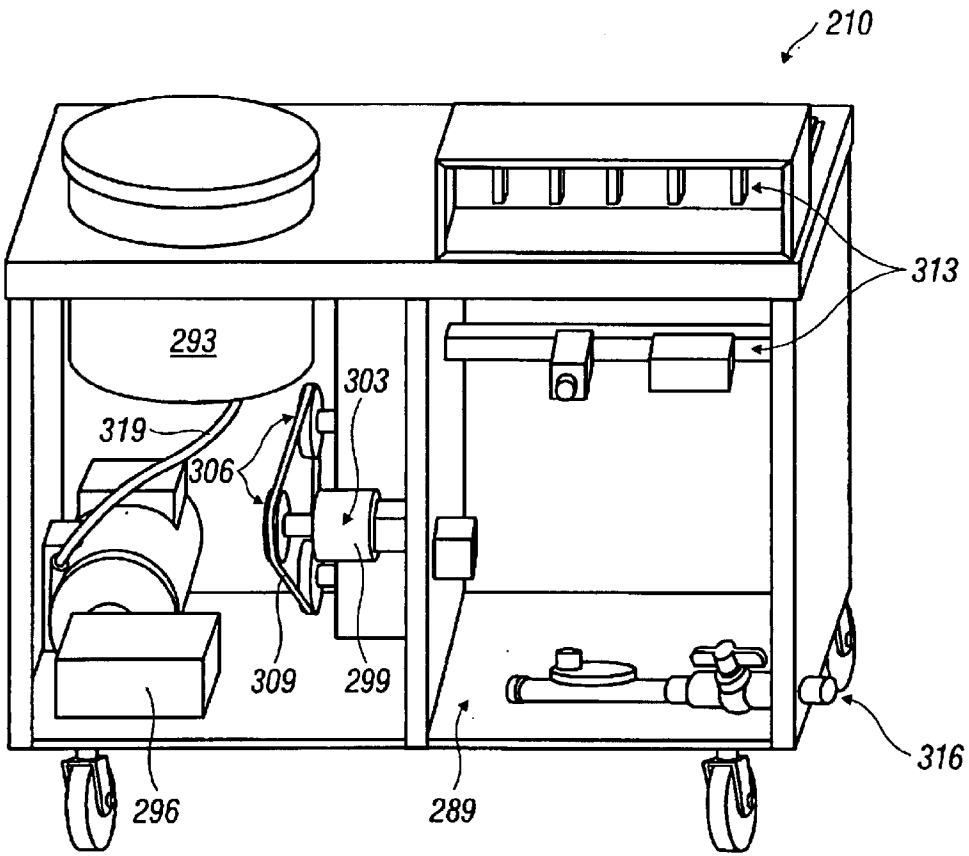
FIG. 9 is a perspective view of a back side of the cleaning system of FIG. 7 illustrating the mechanical and electrical supporting infrastructure outside of the washing compartment with the door open revealing characteristics of the interior of the cleaning compartment.

Referring now to FIGS. 7 and 8, a front-side view of the article cleaning system 210 is shown. A closure member 229, which preferably takes the form of a hinged door 229, is open so that and interior space is exposed for viewing. A cabinet housing 213 forms a protective cover or shroud about the inner workings of the cleaning system 210. Atop the cabinet 213 is a control and information panel 216 utilized by an operator to control and monitor operation of the cleaning system 210. The interface mechanisms between the user and the cleaning system 210 may take the form of any of several suitable configurations. For instance, a fully automated washing cycle may be initiated simply with a push-button actuator. Alternatively, one or more toggle switches may be provided for use to do such things as initiate a complete cleaning cycle or control the component cycles such as scouring, rinsing and other complementary procedures performed during a complete cycle. As enhancements, a drying cycle could be easily added in which either ambient or conditioned air is circulated about the clubs to dry them after the cleansing steps. Protective coatings or rinses may be dispensed after conclusion of the rinse cycle.

The cabinet 213 rests upon a support assembly 219 that in the illustrated embodiment takes the form of four caster wheels 223. The cabinet 213 may, however, be configured to be stationarily installed or mounted on any other suitable transport mechanism.

As shown, the door 229 is constructed with a holding rack 233 connected at a back or interior side thereof. In this manner, the holding rack, together with the golf club heads contained therein, are positioned within the cleaning compartment 226 when the door 229 is closed. In the preferred and shown embodiment, golf club heads rest in the holding rack 233 at a location near the bottom portion of the door 229. The golf club handles extend upwardly therefrom and are installed into access ports 236 which accommodate the positioning of the normally leather-gripped handles outside of the cleaning compartment 226 to prevent their getting wet during the scour and rinse cycles. A buffering seal member (s) 239 is installed in an interior space of the access ports 236. The buffering seals 239 are configured so that the golf club is frictionally held therein at a location below the grip of the club. Not only is a friction fit established for securing the club, but so is a seal about the golf club so that cleaning solution is prevented from escaping the cleaning compartment 226 during the cleaning process.

A lock assembly 243 is provided upon the door 229 and is adapted for latching cooperation, when in a closed configuration, with the housing 213 the cleaning compartment 226. A door seal 246 is positioned interstitially between the door 229 and a front face of the cabinet housing 213. A status sensor 249 is also provided that is capable of detecting whether or not the door 229 is open, closed, and optionally, locked. As a safety precaution, the control circuitry may be configured to require that the sensor must detect that the door is at least closed, and preferably locked, before cleaning operation can be initiated.

Looking to FIG. 8, a close-up view of the interior space of the cleaning compartment 226 is shown. Therein, a pair of guides 253 in the form of two threaded rods are provided and width-wise oriented across the cleaning compartment 226. A carrier 263 is transported upon the parallel guides 253 in a back-and-forth cleaning cycle. Interiorly threaded receivers are provided on the carrier 263 in which the threaded rods 253 are located. When the threaded rods are simultaneously rotated, the interaction of the threading on the rods with the interiorly threaded receivers cause the carrier 263 to travel thereupon. In this manner, the combination acts as a worm gear.

Two nozzle assemblies 266 are mounted on the carrier 263. The connection 276 between the nozzle assemblies 266 and the carrier 263 may be fixed, pivotal, or movable with respect to all three dimensions. By being able to variously configure the two nozzle assemblies 266, different application directions of pressured cleaning solution can be achieved. In the illustrated embodiment, the top nozzle 269 is directed substantially downwardly and the bottom nozzle is directed, at least slightly, upwardly. Because of the fan-shape of the dispensed cleaning solution, excellent cleaning results are achieved because of the thorough coverage enabled by the design of the nozzle assemblies 266 according to the teachings provided herein relative to the nozzle assembly 10. As will be discussed in greater detail hereinbelow, supply conduits 279 may be appreciated in FIG. 7 where fluid carrying conduits 283 and abrasive carrying conduits 286 are shown.

The supply conduits 279 form passages between the cleaning compartment 226 and a mechanical compartment 289. The mechanical compartment 289 is best appreciated in FIG. 9 which is taken from a backside of the cleaning system 210. Control circuitry 313 may be appreciated directly behind the control panel 216 and immediately there below. In compliance with the above teachings concerning a preferred embodiment of the nozzle assembly 10, and of the assembly 110 for entraining abrasive material into the pressure fluid jet, an abrasive receptacle 293 is shown. Connected thereto at a lower position below the receptacle is the metering assembly 115 for controlling the abrasive flow. The abrasive supply conduits 286 are shown connected proximate the bottom portion of the abrasive receptacle 293 and extend through a wall and into the cleaning compartment 226 where the dry abrasive material is ultimately entrained into the pressure cleaning fluid stream.

A high-pressure water pump 296 is provided for supplying pressured cleaning solution, normally in the form of water taken from a standard tap. As an accommodation, a water inlet 316 is located in a lower portion of the mechanical compartment 289 where a standard garden-style hose can be connected for supplying the necessary water to the pump 296. From the pump, the fluid supply conduits 283 are directed into the cleaning compartment 226. Conventional toothed gears 306 are provided, one each, near end portions of the threaded guides 253. The gears 306 are positioned outside of the cleaning compartment 226 in the mechanical compartment 289. An adjustable speed drive motor 299 is connected via a drive chain 309 to each of the two gears 306. In the illustrated embodiment, the speed of the drive motor 299 is controlled using a rheostat 303. Because a common drive chain 309 drives both gears, synchronization is automatic. This is important for smooth traversal of the carrier 263 along the guides 253 in the cleaning compartment 226. Electrical service is provided by electrical power supply connection 319.

In operation, a cleaning cycle exemplarily includes a scouring period and a rinse period. Advantageously, this is achieved in the illustrated embodiment by having the scouring portion of the cycle occur as the carrier 263 initially passes from one end to the other of the cleaning compartment 226 on the guide rods 253. As the carrier 263 approaches the far end of the cleaning compartment 226, a reversing limit switch 256 is tripped. This causes a reversal in the direction of rotation of the guide rods 253 sending the carrier 263 back in the opposite direction toward its starting position. During this back-pass, the dispensation of abrasive particulate from the receptacle to 93 is ceased. This results in a rinse cycle that terminates when the carrier 263 engages a halting limit switch 259. As a result of the halting limit switch 259 being actuated, the washing cycle for the golf clubs ceases. Through out these several component processes of the overall washing cycle, indicative information is being displayed on the information panel 216. In this manner, an operator may monitor the progress of the wash cycle, as well as determine if any difficulties are encountered.

As indicated before, additional procedures may be incorporated into the cleaning process. For instance, a drying step might be added after scouring and rinse. Still further, the application of a spot-free rinse may be applied at conclusion of the rinse cycle. Still further, the configuration shown and described has been specially adapted for golf club cleaning.

It should be equally appreciated that different configurations can be provided for the cleaning of such things as auto parts and other items typically requiring vigorous scouring, often with an abrasive medium included to insure thorough cleaning, and even polishing of the article.

An arrangement for an abrasive entrained power washing device and its components have been described herein. A preferred utilization of the nozzles is also shown in one embodiment of the invention adapted for cleaning golf clubs. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by letters patent is as follows:

1. An abrasive entraining assembly for a pressured fluid stream, said assembly comprising:

a pressured fluid receiving portion adapted to accommodate a pressured fluid dispenser;

an abrasive entrainment chamber oriented to accept pressured fluid jetted thereacross from the pressured fluid dispenser, said abrasive entrainment chamber adapted to establish a venturi suction responsive to pressured fluid being jetted thereacross;

an access port in fluid communication between said abrasive entrainment chamber and an abrasive metering assembly, said access port adapted to permit suction of abrasive into said abrasive entrainment chamber for entrainment in a pressured fluid being jetted thereacross;

said abrasive metering assembly comprising a ball valve positioned at a juncture between an air intake, an abrasive supply and said access port for controlling fluid communication therebetween; and a ball member of said ball valve being adapted to regulate an amount of abrasive permitted to be deployed from said abrasive supply into air taken up through said air intake, wherein said air intake further comprises a variably adjustable closure member adapted to increase and decrease air amounts permitted to be drawn through said air intake by rotation of said closure member.

2. The abrasive entraining assembly of claim 1, further comprising:

a spray enclosure positioned at said abrasive entrainment chamber and oriented to receive pressured fluid dispensed from the pressured fluid dispenser at said pressured fluid receiving portion, said spray enclosure configured to substantially conform to a spray pattern of pressured fluid jetted from the pressured fluid dispenser with minimized influence on the spray pattern at side-edge portions thereof for promoting substantially uniform dispersion of pressured fluid and abrasive across the spray pattern.

3. The abrasive entraining assembly as recited in claim 1, wherein:

said inlet aperture is further positioned at said pressured fluid receiving portion and arranged to spray a substantially fan-shaped pressured fluid jet across said abrasive entrainment chamber, aid fluid jet having a width-wise axis and a height-wise axis, said height-wise axis being measured substantially perpendicular to said width-wise axis;

said fluid jet having two side-edge portions, one each on either of two sides and adjacent to an interior portion of said fluid jet; and said fluid jet having a substantially uniform dispersion along said width-wise axis.

4. The abrasive entraining assembly as recited in claim 2, wherein:

said spray enclosure being substantially fan-shaped in a plane oriented to include a width-wise axis of said fluid jet and perpendicularly intersecting a height-wise axis of said fluid jet, said spray enclosure having interior side walls configured to substantially align, with minimum interference, with outer side-surfaces of the fluid jet.

5. The abrasive entraining assembly as recited in claim 4, said spray enclosure further compromising:

a substantially truncated triangular-shape in said plane oriented to include said widthwise axis of said fluid jet and perpendicularly intersecting said height-wise axis of said fluid jet; and a truncated end forming an inlet for pressured fluid directed thereinto, said spray enclosure flaring outwardly from said inlet to an exit thereof along said plane thereby maintaining a substantially uniform fluid dispersion across said width-wise axis.

6. The abrasive entraining assembly as recited in claim 5, further comprising:

said spray enclosure having top and bottom walls that converge toward one another from said inlet to said exit along said height-wise axis focusing said fluid jet and thereby facilitating said maintenance of said substantially uniform fluid dispersion across said width-wise axis.

7. The abrasive entraining assembly as recited in claim 1, wherein:

said ball member further adjust to prohibit an abrasive load drawable into said abrasive entrainment chamber.

8. The abrasive entraining assembly as recited in claim 1 wherein said closure member further comprises:

a threaded cylindrical portion adapted to be threadedly received in a tapped receiver in said abrasive metering assembly; and at least one inlet aperture extending through a side wall of said closure member and arranged to have a degree of openness adjusted by rotation of said closure member.

9. The abrasive entraining assembly as recited in claim 1, said abrasive metering assembly further comprising:

a housing body having an abrasive supply inlet extending therethrough and arranged to communicate with an abrasive inlet aperture through said ball member of said ball valve when said abrasive entraining assembly is in an abrasive dispensing configuration.

10. The abrasive entraining assembly as recited in claim 9, said ball member further comprising:

an open cylinder extending therethrough and arranged to align with said abrasive supply inlet in an abrasive blocking configuration; and said open cylinder arranged to form a flow-through channel across said abrasive metering assembly in an abrasive dispensing configuration.

11. The abrasive entraining assembly as recited in claim 10 further comprising:

said inlet aperture extends through a wall of said open cylinder and is arranged to dispense abrasive into said abrasive entraining assembly when said abrasive metering assembly is in an abrasive dispensing configuration.

* * * * *